United States Patent [19]

Scheele et al.

[11] Patent Number: 4,865,538

[45] Date of Patent: Sep. 12, 1989

[54] FAIL SAFE GAS VALVE DRIVE CIRCUIT

[75] Inventors: Victor F. Scheele; Stephen E. Youtz, both of Ft. Wayne, Ind.

[73] Assignee: Hamilton Standard Controls, Inc., Farmington, Conn.

[21] Appl. No.: 95,507

[22] Filed: Sep. 10, 1987

[51] Int. Cl.[4] ..... F23N 1/00; F23N 5/24; H03K 3/00

[52] U.S. Cl. ..... 431/18; 431/16; 431/24; 307/234; 307/518; 307/520

[58] Field of Search ..... 431/24, 16, 18; 307/234, 350, 518, 520, 521

[56] References Cited

U.S. PATENT DOCUMENTS

| | | | |
|---|---|---|---|
| 3,299,404 | 1/1967 | Yamarone et al. | 307/234 X |
| 4,034,235 | 7/1977 | Wade | 431/6 X |
| 4,113,419 | 9/1978 | Cade | 431/78 |
| 4,373,139 | 2/1983 | Beesley | 307/350 |
| 4,444,551 | 4/1984 | Mueller et al. | 431/25 |
| 4,507,702 | 3/1985 | Grewe | 431/78 X |
| 4,518,345 | 5/1985 | Mueller et al. | 431/18 X |
| 4,575,333 | 3/1986 | Bryant | 431/18 |
| 4,634,367 | 1/1987 | Kasada | 431/18 X |
| 4,695,246 | 9/1987 | Beilfuss et al. | 431/31 |

*Primary Examiner*—Robert E. Garrett
*Assistant Examiner*—Carl D. Price

[57] ABSTRACT

A fail safe drive circuit for enabling the relay which in turn opens the valve for supplying gas to a burner is disclosed and includes a pair of field effect transistors both of which must be operating properly to enable the relay. One transistor receives an enabling input from a rectifier circuit and will be enabled only if the alternating input signal is of sufficient magnitude and repetition rate. The other transistor is turned on and off by the alternating input signal and the gas valve will be turned on only when each of the transistors is operating in its intended mode. The circuit thus discriminates against false enabling signals such as a direct current signal, line voltage signal, a non-repetitive alternating current signal, or other spurious signal.

6 Claims, 1 Drawing Sheet

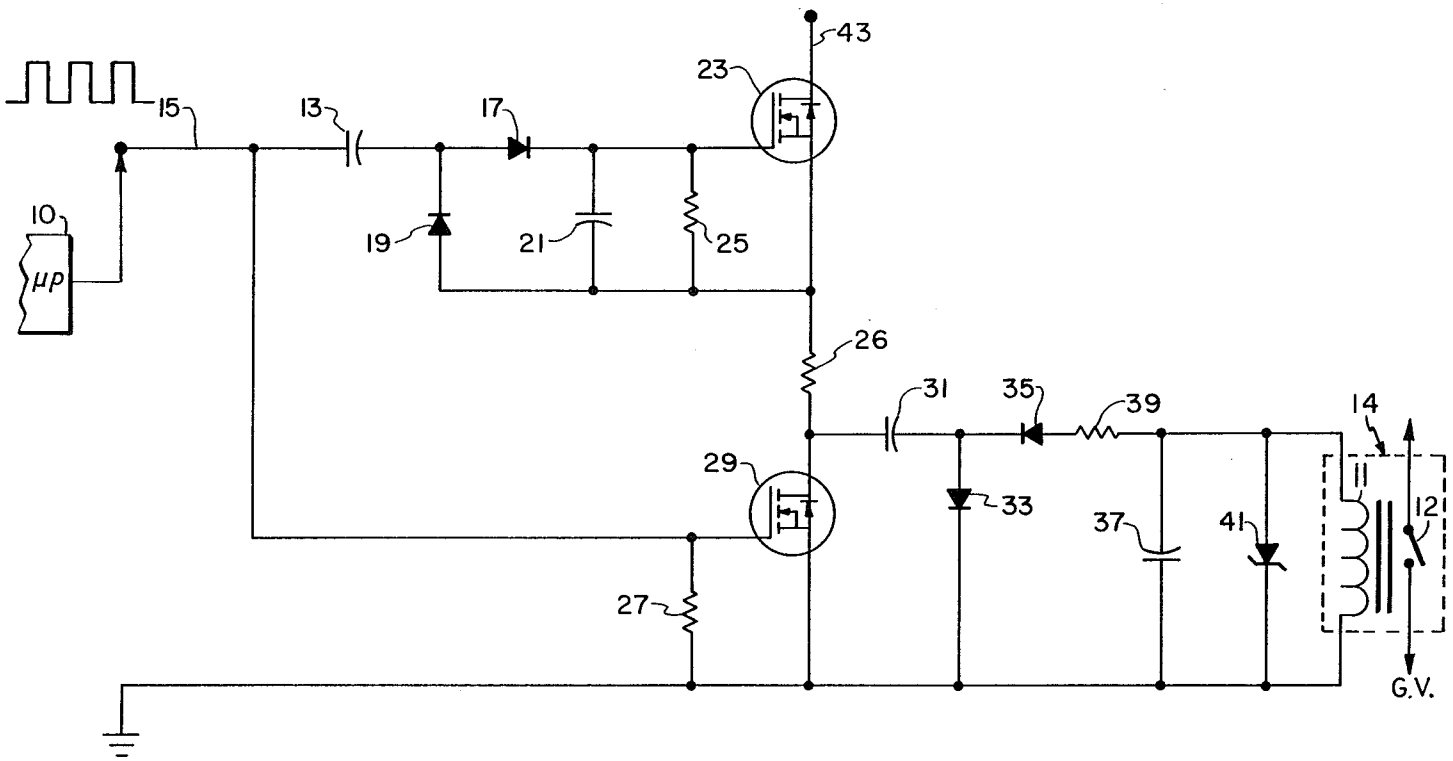
43
23
25
21
17
19
13
15
10
μp
26
31
35
39
33
37
41
29
27
14
12
G.V.

FAIL SAFE GAS VALVE DRIVE CIRCUIT

SUMMARY OF THE INVENTION

The present invention relates generally to electronic controls for burners, furnaces and the like, and more particularly to an integrated control for such burners in the illustrative environment of a gas-fired furnace.

Older furnace control systems have taken a modular approach with separate controls for functions such as gas ignition, a blower fan, the gas valve or valves, induced draft sensing, and thermostat setback operations. The integrated furnace control has taken all of the furnace control functions and combined them with the thermostat setback function into one main control module. The combining of all these functions into one complete module has made the system more cost effective than using separate components, allows many additional features, and provides a safer control.

Integrated furnace control units, or units having at least some of the attributes of integrated control systems have also been known for some time. Several prior patents illustrative of these known arrangements are recited in copending applications Ser. No. 07/095,508 and Ser. No. 07/095,506 each assigned to the assignee of the present application, entitled Integrated Furnace Control and Control Self Test in the names of Mierzwinski, Grunden and Youtz and Integrated Furnace control Having Ignition and Pressure Switch Diagnostics in the names of Grunden, Youtz and Mierzwinski respectively. In these related applications there are disclosed companion integrated furnace control systems sharing many features and adapted to incorporation of the present invention. The entire disclosures of those applications is specifically incorporated herein by reference.

Conventional burner or furnace systems frequently include a double valve type failsafe electro-mechanical gas valve along with a drive circuit for that gas valve typically employing a gas valve enabling relay. Overall burner safety can be enhanced by operating the drive circuit in an equally fail-safe manner in accordance with the principles of the present invention.

Among the several objects of the present invention may be noted the provision of a fail-safe gas valve drive circuit; the provision of a drive circuit for a furnace component which includes a pair of electronic switching devices both of which must operate properly before the furnace component will be actuated; the incorporation of additional cross-checking circuitry into a burner control for enhanced safety; the provision of a circuit for enabling a burner control component which guards against false enabling signals; and the overall enhancement of safe burner operation. These as well as other objects and advantageous features of the present invention will be in part apparent and in part pointed out hereinafter.

In general, a burner control system confirms that a component enabling signal is a proper one. For example, in an integrated burner control for a gas burner of the type having at least one gas valve control relay operable upon command from a microprocessor in the integrated burner control to open a gas valve and supply gas to a burner combustion chamber, the system is responsive to a repetitive alternating signal from the microprocessor for enabling the gas valve control relay only when the signal is of at least a predetermined voltage level and within a predetermined range of repetition rates.

Also in general and in one form of the invention, a burner gas valve drive circuit for enabling a gas valve control relay in response to an alternating input signal at an input terminal rectifies the input signal and has a switch responsive to the rectified signal to change from a nonconducting to a conducting state. A second switch is responsive to the alternating input signal to alternate between conducting and nonconducting states and the gas valve relay is enabled only when the first switch is in a conducting state and the second switch is alternating between conducting and nonconducting states.

Further in general, and in one form of the invention, a burner gas valve drive circuit which is adapted to enable a gas valve control relay in response to an alternating input signal at an input terminal has first means for determining if the alternating input signal is of sufficient magnitude and sufficiently high repetition rate to be a true enabling signal, and second means enabled by the input signal only if the first means determines the input signal to be a true enabling signal for enabling the gas valve control relay.

BRIEF DESCRIPTION OF THE DRAWING

The drawing is a schematic illustration of a gas valve relay drive circuit incorporating the invention in one preferred form.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Referring now to the drawing, there are basically two identical circuits utilized to drive the gas valve relay coil 11 to control contacts 12 of gas valve relay 14. Each performs similarly to a half wave voltage doubler taking a component enabling square wave input on line 15, for example, from a microprocessor 10 such as disclosed in either of the abovementioned copending applications, and charge a first capacitor 13 to the peak rectified voltage during half of the cycle and, during the other half of the cycle, charging another capacitor 21. The resultant direct current voltage is equal to the peak voltage less losses which are on the order of ten to twenty percent.

During the positive portion of the input cycle on line 15, diode 17 conducts while diode 19 is reverse biased and cut off, thus charging capacitor 13 up to the peak voltage. During the low voltage portion of the cycle, diode 17 is cut off and diode 19 conducts, thereby charging capacitor 21. The voltage generated by this process when applied between the gate and source terminals of the field effect transistor 23 will reduce the resistance between the source and drain of transistor 23 to essentially zero. Thus the field effect transistor 23 acts as a gate or switch which is on or conducting when a five volt square wave is present on line 15 and off when that signal is not present. The resistor 25 is present to pull down the voltage on the gate terminal of the transistor 23 and reduce noise problems.

The resistor 27 is similarly present to reduce noise problems at the input of field effect transistor 29. Transistor 29 functions as a driver for the gas valve coil 11. With the square wave input on the gate of transistor 29, the voltage across the transistor (drain to source) varies in inverse proportion to the input. This voltage variation when applied to capacitor 31 charges that capacitor to the peak of the waveform. During this charging portion of the cycle, diode 33 conducts while diode 35 is reverse biased or blocking. During the low voltage portion of the waveform, diode 33 is cut off and diode 35 conducts to charge capacitor 37. On the next positive half cycle, diode 35 is cut off and capacitor 37 discharges through coil 11. Resistor 39 is a current limiting resistor while Zener diode 41 clips the voltage across the coil 11 to limit coil heating.

The circuit for enabling the gas valve relay uses a selected frequency in the range of 30 to 2000 Hertz. For example, in one specific embodiment for the circuit shown, a 1700 Hertz alternating current component enabling signal from a microprocessor on line 15 which alternately turns field effect transistor 29 on and off was used. This signal on line 15 is passed through an ac-dc converter or rectifier including capacitor 13, diode 19, diode 17 and capacitor 21 to also turn field effect transistor 23 on. This provides a 4 to 20 volt bias, depending on the frequency, between the source and gate of 23 when the alternating current signal is present on line 15. Resistor 25 is present to turn off 23 when the signal on line 15 is removed. The capacitors 13 and 21 are selected so that the signal on line 15 msut be at least 30 Hertz to enable 23. Diodes 33 and 35, and capacitors 31 and 37 provide another ac-dc converter for supplying negative 12 volts to the coil 11 of the relay and the Zener diode 41 functions to both regulate this voltage and to limit the power dissipated by the coil when it is turned off. Current flow through the Zener diode 41 is limited by resistor 39. Resistor 27 ensures that transistor 29 is off when the microprocessor is not driving its gate. The current through transistor 29 is limited by resistor 26 in the line 43 to a apositive direct current voltage source. The values of this last resistor and capacitors 31 and 37 are selected to provide efficient transfer of power to the coil 11 of the relay.

It should now be clear that field effect transistor 23 must be on and field effect resistor 29 must be alternately on and off to enable the gas valve relay coil 11. Transistor 23 is AC coupled to the input line 15 while transistor 29 is DC coupled to the input line. The relay coil 11 is AC coupled to its drive. This gives an additional measure of safety in that failure of either transistor circuit will prevent the gas valve from being enabled.

From the foregoing, it is now apparent that a novel fail-safe gas valve drive circuit arrangement has been disclosed meeting the objects and advantageous features set out hereinbefore as well as others, and that numerous modifications as to the precise shapes, configurations and details may be made by those having ordinary skill in the art without departing from the spirit of the invention or the scope thereof as set out by the claims which follow.

What is claimed is

1. In an integrated burner control for a gas burner of the type having at least one gas valve control relay operable upon command from a microprocessor in the integrated burner control to open a gas valve and supply gas to a burner combustion chamber, the command from the microprocessor comprising a repetitive alternating command signal of a selected frequency, the improvement comprising electrically interconnected first and second switching devices, an alternating current to direct current convertor responsive to the command signal fro the microprocessor to supply a first direct current signal to the first switching device enabling the first switching device to permit a second direct current signal from a direct current to be transmitted to the second switch device, the second switching device being alternately enabled to conduct and disabled to a blocking state by the alternating command signal from the microprocessor to cause the second direct current signal to be changed to an alternating current signal, the gas valve control relay being electrically connected to said second switch device and arranged to be enabled only when the first switching device is enabled and the second switching device is being alternately enabled and disabled.

2. The improvement of claim 1 wherein the first and second switching devices are field effect transistors.

3. A burner gas valve drive circuit adapted to enable a gas valve control relay in response to an alternating input signal at an input terminal comprising means for rectifying the input signal, first switch means electrically connected to a second input terminal adapted to receive a direct current signal and responsive to the rectified signal to change from a nonconducting to a conducting state for controlling the direct current signal, and second switch means electrically connected to said first switch means and responsive to the alternating input signal to alternate between conducting and nonconducting states for changing the direct current signal to an alternating current signal, the gas valve relay being electrically connected to said first and second switch means and arranged to be enabled only when the first switch means is in a conducting state and the second switch means is alternting between conducting and nonconducting states.

4. The burner gas valve drive circuit of claim 3 wherein the first and second switch means each comprise transistors.

5. The burner gas valve drive circuit of claim 3 wheein the first switch means is enabled only when the alternating input signal is of at least a predetermined voltage level and within a predetermined range of repetition rates.

6. The burner gas valve drive circuit of claim 5 wherein the alternating input signal must be at least 30 Hertz to enable the first switch means.

* * * * *